US006508304B2

(12) United States Patent
Gagliardi

(10) Patent No.: US 6,508,304 B2
(45) **Date of Patent: *Jan. 21, 2003**

(54) MULTI-STAGE LIQUID ELEVATOR

(76) Inventor: John Gagliardi, 191 Wall St., Clairton, PA (US) 15025

( * ) Notice: Subject to any disclaimer, the term of this patent is extended or adjusted under 35 U.S.C. 154(b) by 0 days.

This patent is subject to a terminal disclaimer.

(21) Appl. No.: 09/900,792

(22) Filed: Jul. 6, 2001

(65) Prior Publication Data

US 2002/0005285 A1 Jan. 17, 2002

Related U.S. Application Data

(63) Continuation-in-part of application No. 09/783,891, filed on Feb. 14, 2001, which is a continuation-in-part of application No. 09/615,286, filed on Jul. 13, 2000, now abandoned, and a continuation-in-part of application No. 09/633,073, filed on Aug. 4, 2000, now abandoned.

(51) Int. Cl.[7] ..... E21B 17/18; E21B 43/16; F04B 25/00

(52) U.S. Cl. ..... 166/105; 166/242.3; 166/372; 417/250

(58) Field of Search ..... 166/372, 242.3, 166/369, 115, 325, 105; 417/121, 102, 125, 244, 250, 230

(56) References Cited

U.S. PATENT DOCUMENTS

| | | | |
|---|---|---|---|
| 50,893 | A | 11/1865 | Blackie |
| 248,749 | A | 10/1881 | Hudson |
| 657,917 | A | 9/1900 | Conrader |
| 664,723 | A | 12/1900 | Conrader |
| 721,594 | A | 2/1903 | Moran |
| 850,037 | A | 4/1907 | Moser |
| 865,296 | A | 9/1907 | Conrader |
| 1,390,085 | A | 9/1921 | Cassisa |
| 1,444,442 | A | 2/1923 | Allen |
| 1,581,536 | A | 4/1926 | Gregory |
| 1,663,312 | A | 3/1928 | Miles |
| 1,749,151 | A | 3/1930 | Miles |
| 1,833,214 | A | 11/1931 | Gray et al. |
| 1,875,440 | A | 9/1932 | Gilbert |
| 2,131,183 | A | 9/1938 | Key |
| 2,855,860 | A | 10/1958 | Crump |
| 3,829,246 | A | 8/1974 | Hancock |
| 4,050,854 | A | 9/1977 | Hereford et al. |
| 4,231,712 | A | 11/1980 | Shing-Hsiung |
| 4,278,405 | A | 7/1981 | Angle |
| 4,700,783 | A | 10/1987 | Baron |
| 4,801,246 | A | 1/1989 | Baumberg |

FOREIGN PATENT DOCUMENTS

| | | |
|---|---|---|
| CA | 662463 | 5/1963 |
| RU | 1622642 | 3/1989 |

*Primary Examiner*—David Bagnell
*Assistant Examiner*—Jennifer H. Gay
(74) *Attorney, Agent, or Firm*—Buchanan Ingersoll, P.C.

(57) ABSTRACT

A multi-stage liquid elevator is assembled from individual stages in which each elevator stage is fabricated from ordinary pipe components and has no moving parts. When inserted into an natural gas well, the elevator is powered by the gas pressure available in the well. At each stage, the liquid and gas from the previous stage are forced into the inlet pipe and the liquid collects in the reservoir until enough gas pressure builds up in the stage to force the liquid up the outlet pipe to the next stage. The elevator requires only enough pressure from the well to move a column of liquid a vertical distance equal to or greater than the length of one stage of the elevator.

24 Claims, 8 Drawing Sheets

MULTI-STAGE LIQUID ELEVATOR

RELATED APPLICATIONS

This application is a continuation-in-part application of U.S. application Ser. No. 09/783,891 filed Feb. 14, 2001 entitled "MULTI-STAGE LIQUID ELEVATOR," which is a continuation-in-part of U.S. application Ser. No. 09/615,286, now abandoned, filed Jul. 13, 2000 and Ser. No. 09/633,073, now abandoned, filed Aug. 4, 2000.

FIELD OF THE INVENTION

This invention relates to the field of oil and gas wells, and, more specifically, to oil and gas wells having relatively low gas pressures insufficient to raise a column of liquid out of the well.

BACKGROUND OF THE INVENTION

Gas and oil wells become unproductive because existing gas pressure in the production zone is reduced by natural depletion to a level which cannot force liquids, in most cases water or oil, from the well, thereby creating a liquid plug and blocking further recovery of gas and liquid products. It would therefore be desirable to be able to raise the liquid from the well utilizing the gas pressure existing in the well. Further, it would be desirable to provide a device able to accomplish this task without moving parts and without the introduction of additional energy, in any form, into the well.

SUMMARY OF THE INVENTION

The invention comprises a multi-level liquid elevator having a plurality of vertically-stacked stages. Each of the stages is of a length which is compatible with the available pressure in the well. That is, the pressure in the well is sufficient to push liquid at least the length of the stage. This allows the liquid blocking the well and the liquid and gas products available in the well to be raised, stage by stage, to any desired elevation, thereby freeing the well for renewed operation.

The invention as described may also be utilized for other applications requiring the raising of liquid, such as the filling of a standpipe on a tall building utilizing a small air compressor instead of a large motor driven pump or a series of pumps.

DETAILED DESCRIPTION OF THE INVENTION

Figure 1:
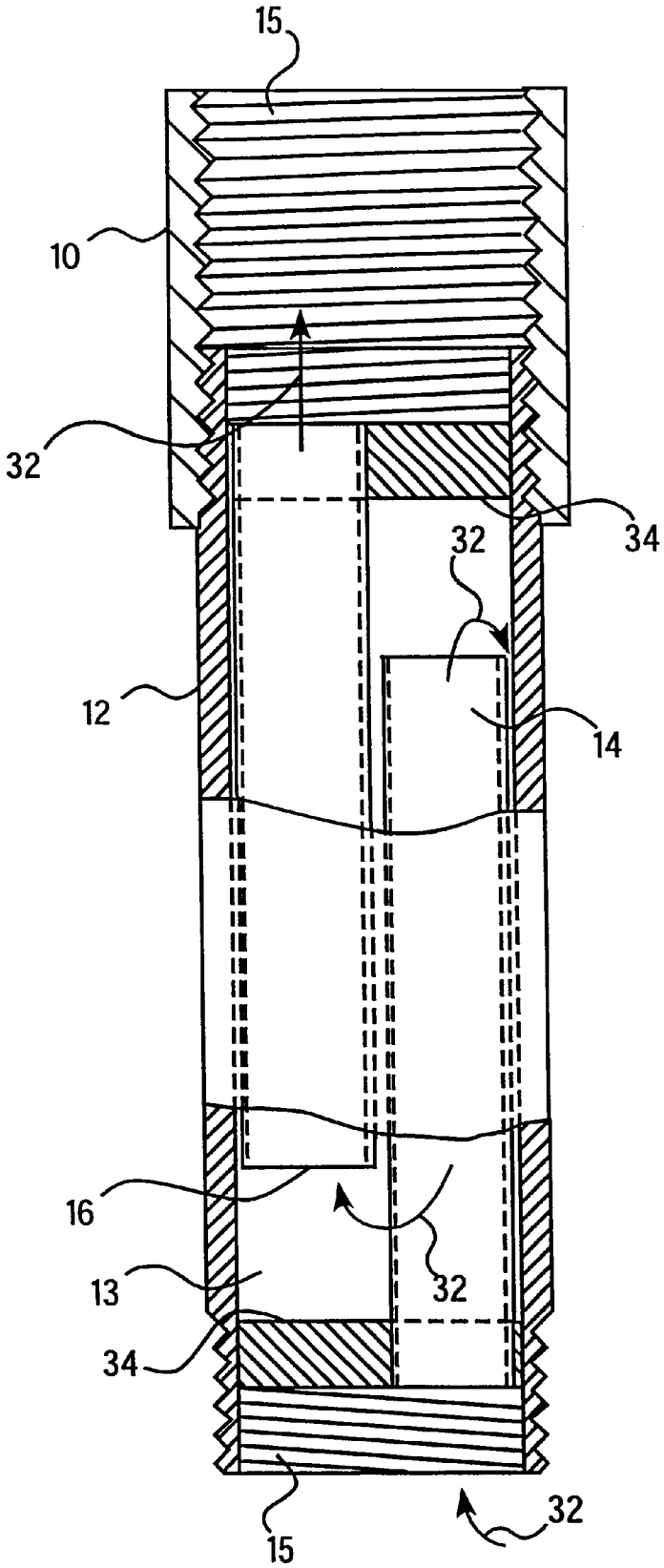
FIG. 1 shows the preferred embodiment of a single stage of the liquid elevator of the present invention.
Figure 2:
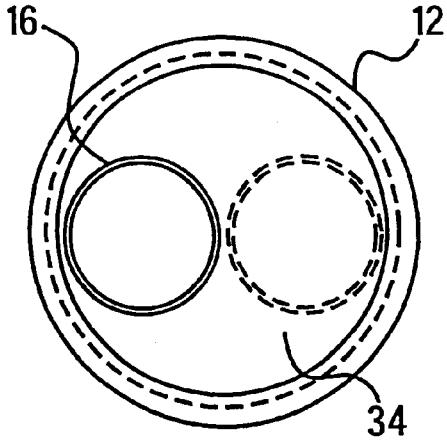
FIG. 2 shows a top view of a single stage of the liquid elevator of FIG. 1.
Figure 3:
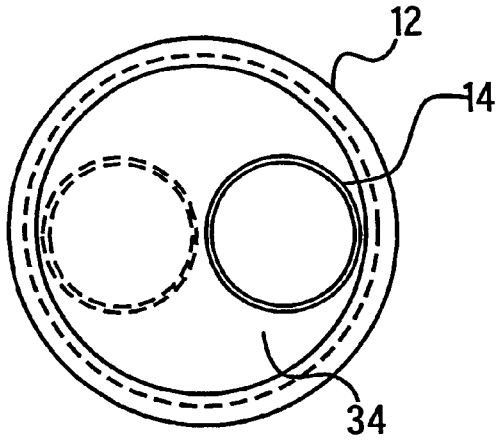
FIG. 3 shows a bottom view of a single stage of the liquid elevator of FIG. 1.

FIG. 1 shows a single stage of the preferred embodiment of the liquid elevator of the present invention. Liquid is forced up filler pipe 14 by existing pressure in the well. The lengths of filler pipe 14 and riser pipe 16 are determined by the pressure available in the well. Wells having lower pressures will require a greater number of shorter stages to raise the liquid a given height than wells having a higher pressure, which would require fewer, longer stages to raise the liquids a given height.

When the liquid reaches the top of filler pipe 14, it overflows into and begins to fill reservoir 13, defined by outer casing 12. As gas percolates up through the liquid, pressure builds up in reservoir 13 equalizing with the existing well pressure. Liquid and gas 32 are then forced into riser pipe 16. Upon reaching the top of riser pipe 16, the liquid and gas is forced into the next stage of the elevator through space 15. The combined length of riser pipe 16 from a lower stage and filler pipe 14 from the next higher stage must be shorter then the height the existing well gas pressure can raise a liquid column. The various stages of the elevator are connected via coupler 10. The process is then repeated for every identical stage stacked atop the lowest stage until the desired elevation is reached.

Figure 4:
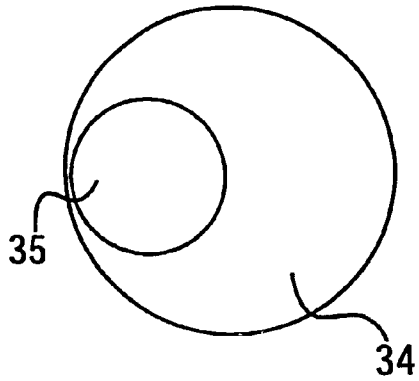
FIG. 4 shows a header used at the top and bottom of each stage of the elevator.
Figure 6:
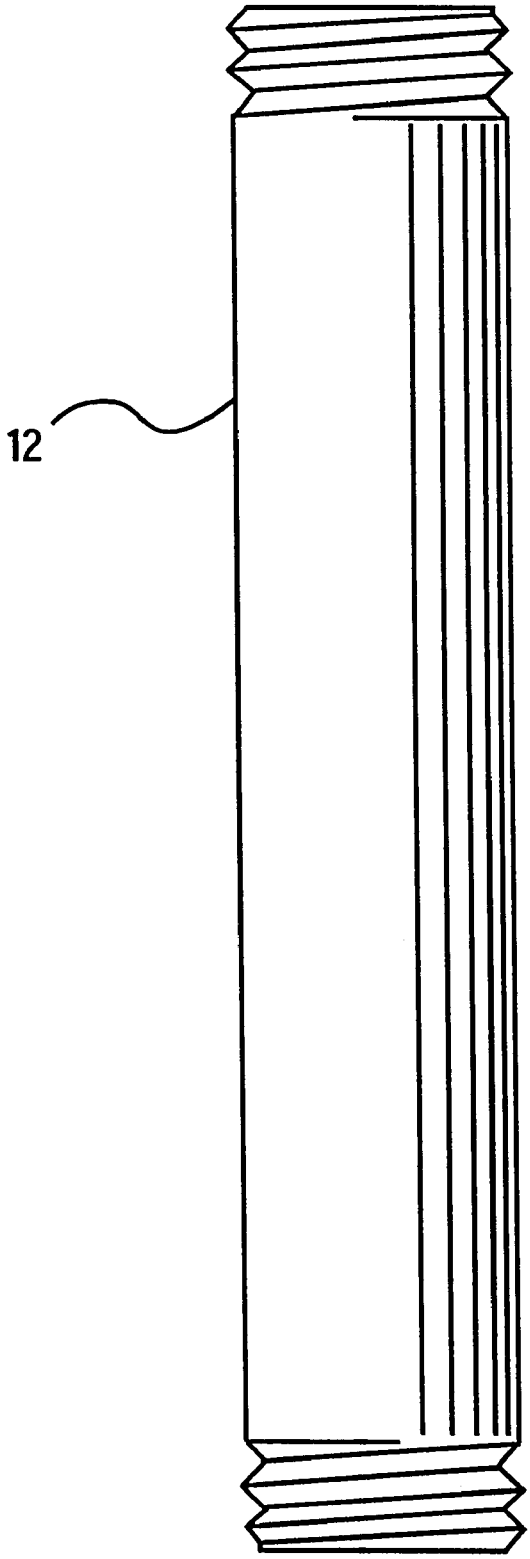
FIG. 6 shows an outside view of a single stage of the preferred embodiment.

A single stage of the preferred embodiment of the elevator is constructed as such. Filler pipe 14 is welded into hole 35 defined in header 34, shown in FIG. 4. Preferably, the inside diameter of hole 35 matches the outside diameter of filler pipe 14, allowing filler pipe 14 to be inserted therein and welded in place. Header 34 is welded to the inside of pipe casing 12, displaced from the end of casing 12, creating space 15 at the end of casing 12. Preferably, the outside diameter of header 34 will match the inside diameter of casing 12, allowing header 34 to be inserted therein. In a like manner, riser pipe 16 is affixed at the opposite end of casing 12 using a header 34 identical to the header used for filler pipe 14. As can be seen in FIG. 6, from the outside, a single stage of the elevator looks like an ordinary section of pipe, thereby allowing the use of ordinary couplers 10 to connect the various stages of the elevator.

Figure 5:
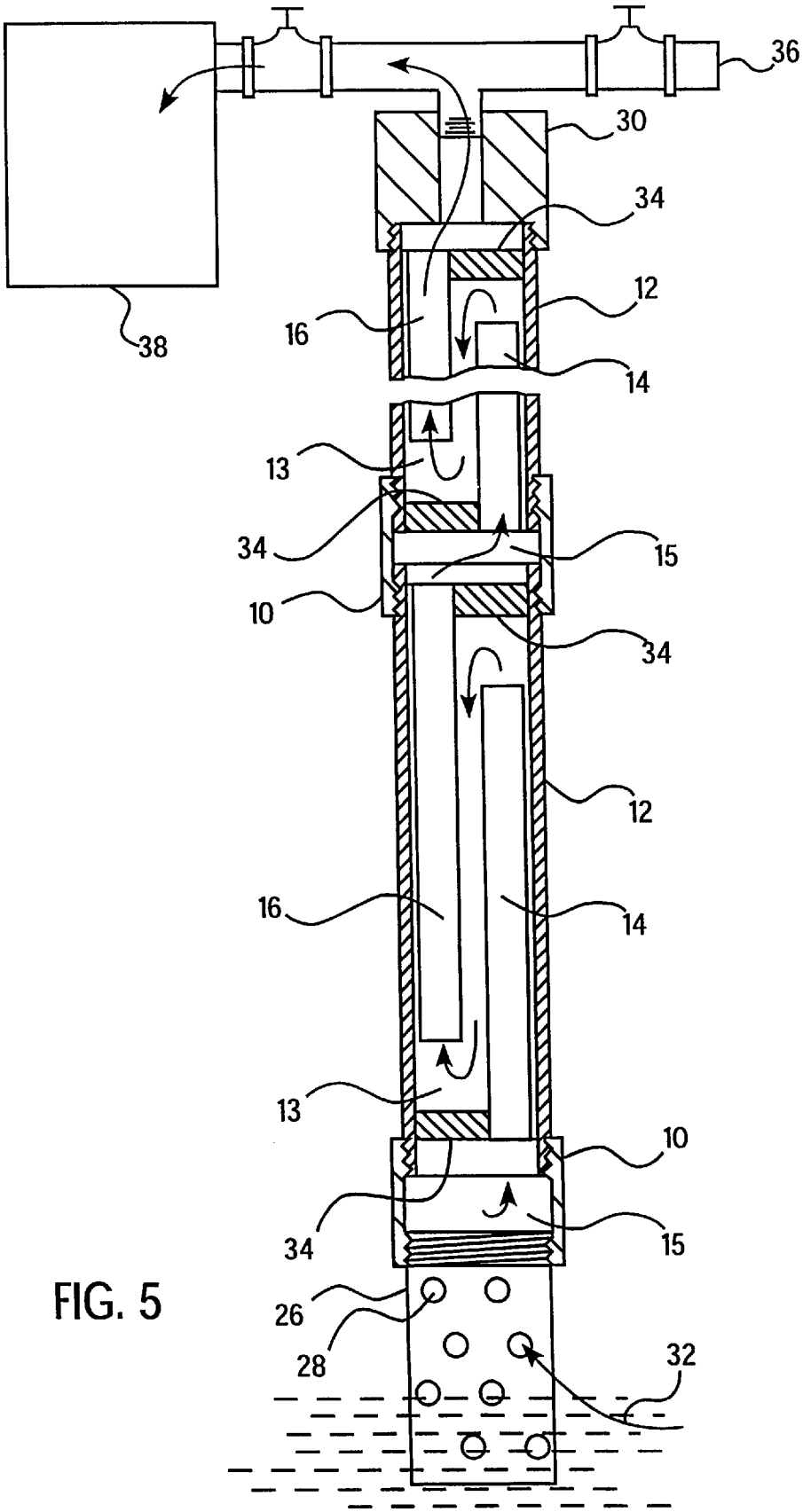
FIG. 5 shows the liquid elevator of the preferred embodiment having multiple connected stages.

FIG. 5 shows multiple stages of the preferred embodiment stacked together. Liquid and gas 32 are forced by existing well gas pressure through strainer 26, through coupling 10 and into filler pipe 14 of the first stage. Holes 28 in strainer 26 are preferably made smaller than any opening in the multi-stage liquid elevator to prevent blocking the system with debris. The flow of liquid and gas 32 is shown by arrows.

At the head of the well, elevator cap 30 secures the multi-stage liquid elevator and liquid and gas 32 are directed any suitable accessory. Shown is a separator 38 from which the desired product, liquid or gas, can be withdrawn, and purge line 36, which is provided to backflush the system if necessary.

Accordingly, the reader will see that as long as the length of each stage of the multistage liquid elevator is shorter than the height the existing well gas pressure will normally raise a liquid, liquid and gas can be raised to any desired elevation.

Figure 7:
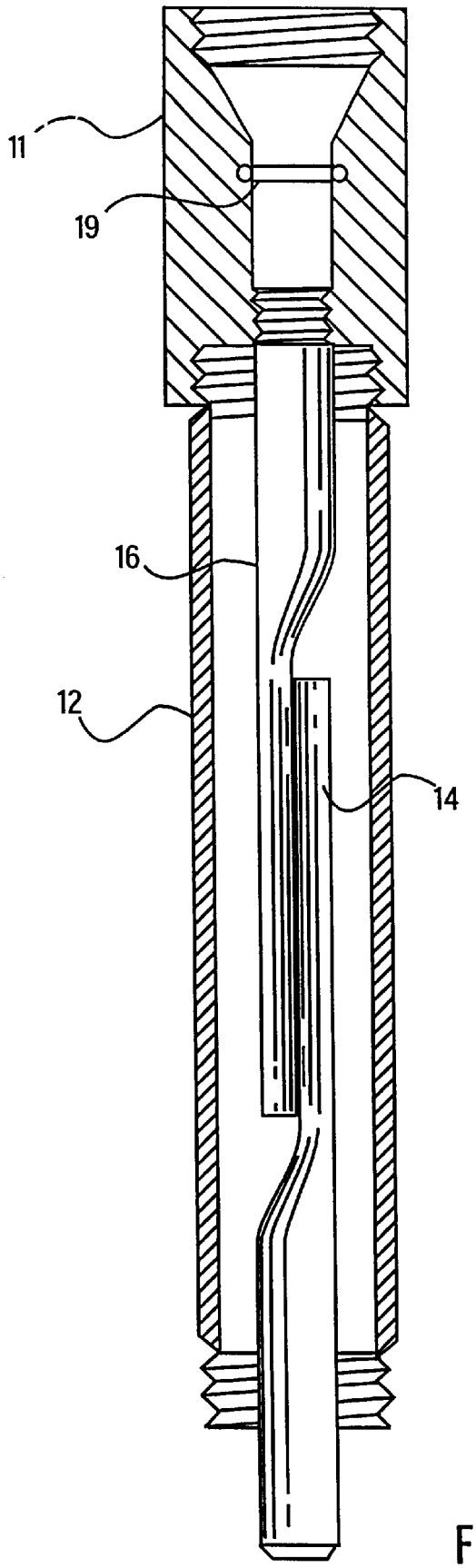
FIG. 7 shows a second embodiment of a single stage of the liquid elevator of the present invention.
Figure 9:
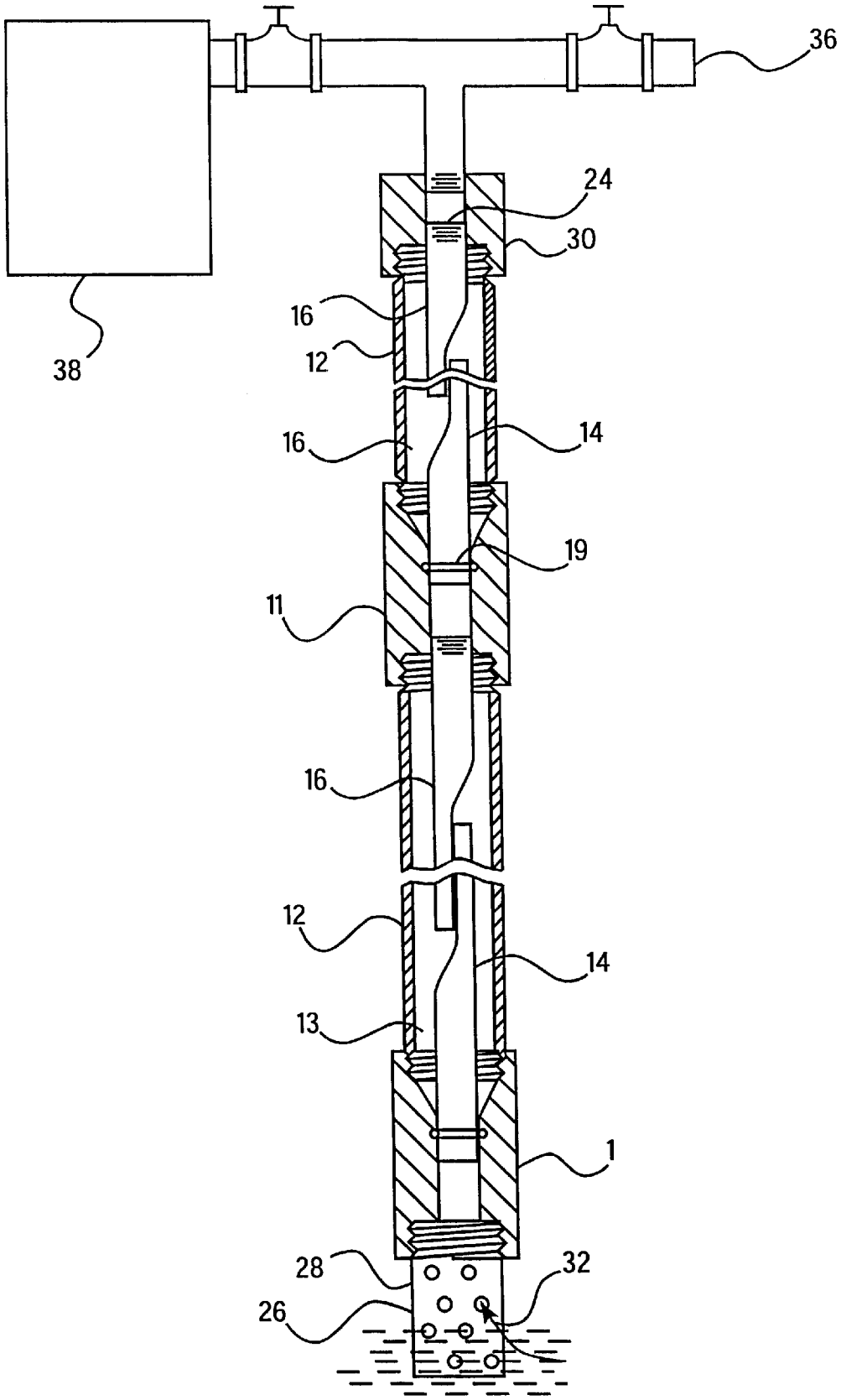
FIG. 9 shows the liquid elevator of the second embodiment having multiple connected stages.

Shown in FIG. 7 is a single stage of a second embodiment of the invention. The main difference distinguishing this embodiment and the preferred embodiment previously described is that the inlet to filler pipe 14 and the outlet from riser pipe 16 are radially aligned with each other and with casing 12. This eliminates turbulence caused by the redirection of liquid and gas 32 as it passes through spaced 15 between stages in the preferred embodiment and promotes a smoother flow. Use of this embodiment requires coupler 11 to match the outlet of riser pipe 16 with the inlet of the filler pipe 14 of the next higher stage. Also, coupler 11 performs the function of headers 34 in the preferred embodiment, the separation of the stages. Filler pipe 14 fits into the funnel-shaped section of coupler 11, and the connection is sealed using O-ring 19. The filler pipe 14 of an upper stage receives flow from the riser pipe 16 of the lower stage, just as in the preferred embodiment, but through coupler 11. FIG. 9 shows multiple stages of the second embodiment connected together.

Figure 8:
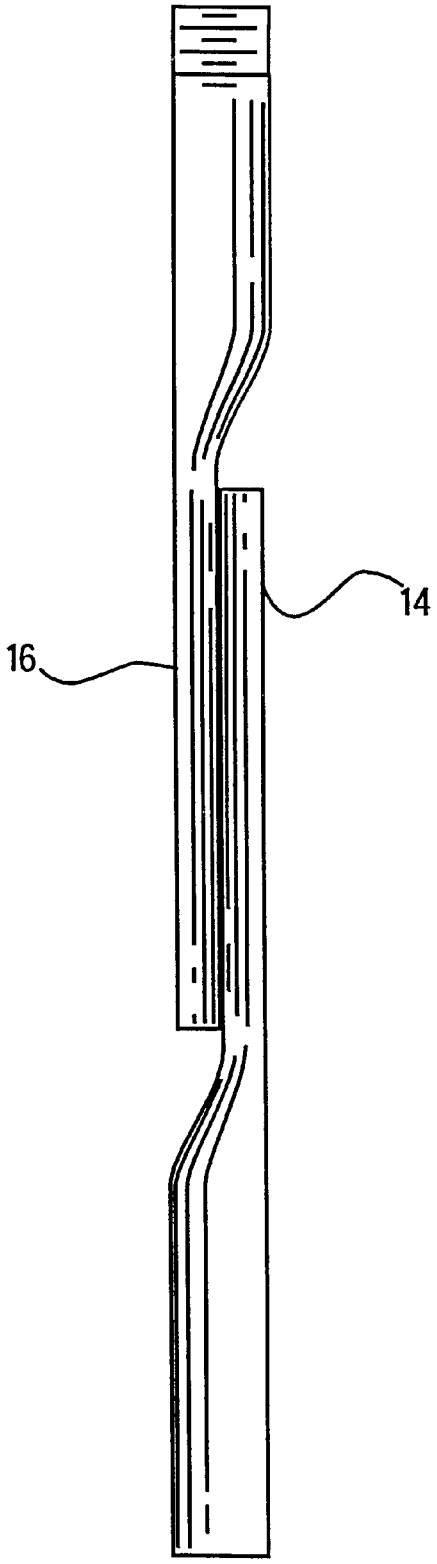
FIG. 8 shows in inside configuration of the filler and riser pipes of the second embodiment.
Figure 8A:
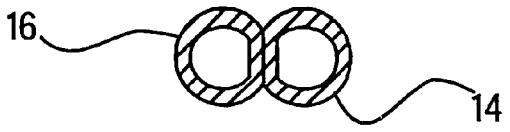
FIG. 8*a* is a top view of the pipes of FIG. 8, showing the flat side of the pipes.

Note that the configuration of the filler and riser pipes 14 and 16 within casing 12 in this embodiment is not an important aspect of the invention. One possible configuration of filler and riser pipes 14 and 16 is shown in detail in FIGS. 8 and 8*a* wherein a portion of pipes 14 and 16 are flattened to accommodated each other within casing 12, however, any suitable internal configuration could be used, such as having the inlet of filler pipe 14 and the outlet of riser pipe 16 at the radial center of the casing opposite ends of these pipes near the wall of casing 12, such that pipes 14 and 16 would appear "tilted" within casing 12. As long as the outlet from filler pipe 14 is above the level of the inlet to riser pipe 16, any configuration should be acceptable.

Figure 10:
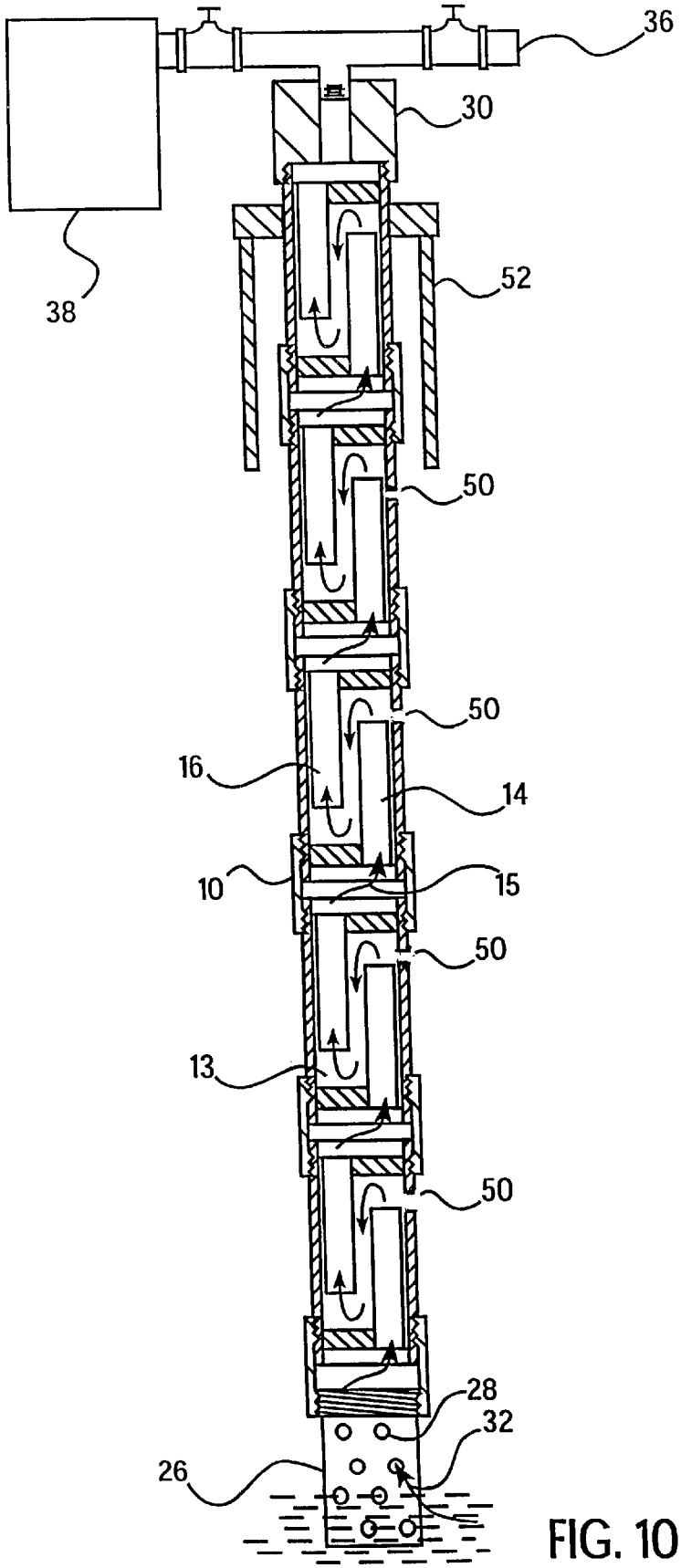
FIG. 10 shows a third embodiment of the invention wherein pressure from the well annulus is introduced at each stage.

FIG. 10 shows a third embodiment of the present invention which is a modification of the preferred embodiment. In this embodiment, pressure from the well, which is present within annulus 52 in introduced to each stage of the elevator via holes 50 defined in the wall of the casing of each stage to aid in pushing the liquid up riser pipe 16.

Shown in this disclosure are three embodiments of a liquid elevator. It is possible that one of skill in the art could conceive of additional configurations that would operate based on the principals disclosed herein. Therefore, the scope of this invention is not meant to be limited by the example configurations shown, but is embodied in the following claims.

I claim:

1. A liquid elevator comprising:

an sealed outer casing having a first side defining a first hole and a second side defining a second hole;

a first pipe having one end sealed within said first hole such that liquids or gasses entering or exiting said first hole must pass through said first pipe;

a second pipe having one end sealed within said second hole such that liquids or gasses entering or exiting said second hole must pass through said second pipe; and a reservoir area within said sealed outer casing, said casing defining a third hole therein allowing communication between said reservoir and the outside of said casing.

2. The liquid elevator of claim 1 wherein said first and said second pipes are configured such that the end of said first pipe opposite said first hole is at least as close or closer to said second side as the end of said second pipe opposite said second hole.

3. The liquid elevator of claim 1 wherein said sealed outer casing comprises:

a pipe;

a first header having the shape of a cross section of said pipe, said first header defining said first hole therein; and a second header having the shape of a cross section of said pipe, said second header defining said second hole therein;

where said first and said second headers are placed near opposite ends of said pipe such as to seal said pipe, but for said holes defined in said headers.

4. The liquid elevator of claim 3 wherein said headers are welded to said pipe.

5. The liquid elevator of claim 4 wherein one end of said first pipe is sealed in said first hole such that said end of said first pipe is substantially flush with the outside of said first header and wherein one end of said second pipe is sealed in said second hole such that said end of said second pipe is substantially flush with the outside of said second header.

6. The liquid elevator of claim 5 wherein said pipes are sealed in said holes in said headers by welding.

7. The liquid elevator of claim 1 wherein said first and said second holes are centered in said first and said second sides respectively.

8. A liquid elevator comprising:

a plurality of stages, each of said stages comprising:

an sealed outer casing having a first side defining a first hole and a second side defining a second hole;

a first pipe having one end sealed within said first hole such that liquids or gasses entering or exiting said first hole must pass through said first pipe;

a second pipe having one end sealed with said second hole such that liquids or gasses entering or exiting said second hole must pass through said second pipe; and a reservoir, defined within said outer casing, said casing defining a third hole therein allowing communication between said reservoir and the outside of said casing;

said stages being vertically stacked such that liquids or gasses exiting a lower stage enter the next higher stage.

9. The liquid elevator of claim 8 wherein said first and said second pipes are configured such that the end of said first pipe opposite said first hole is at least as close or closer to said second side as the end of said second pipe opposite said second hole.

10. The liquid elevator of claim 8 further comprising a plurality of couplings interspersed between adjacent ones of said plurality of stages.

11. The liquid elevator of claim 10 wherein each of said plurality of stages is cylindrical in shape and defines threads on the outside diameter thereof and further wherein said couplings are connected to said stages via said threads.

12. The liquid elevator of claim 8 wherein said first and said second holes are centered in said first and said second sides respectively, such that said first hole from any stage of said elevator is radially aligned with said second hole from the next highest stage of said elevator.

13. The liquid elevator of claim 8 further comprising a perforated screen attached to the lower end of the lowest of said stages.

14. The liquid elevator of claim 8 further comprising a fitting attached to said upper end of the highest of said stages, said fitting being capable of accepting any one of a plurality of standard well head attachments.

15. The elevator of claim 8 wherein said elevator is disposed in the annulus of a well and wherein said third holes in each of said stages allow communication between said reservoirs and said annulus.

16. The elevator of claim 15 wherein said annulus of said well is pressurized to the natural pressure of the well.

17. A liquid elevator comprising:

a plurality of vertically stacked chambers, said chambers being separated by a header having a hole defined therein;

a plurality of pipes, each of said pipes extending through one of said plurality of holes and being sealed therein; and a reservoir defined with said chamber, said chamber defining a hole therein allowing communication between said reservoir and the outside of said chamber.

18. A liquid elevator comprising:

an outer casing having a top defining a first hole in the center thereof and an open bottom;

a first pipe having one end sealed within said first hole and extending into said casing; and a second pipe extending out through said open bottom of said casing, said outer casing defining a second hole therein.

19. The liquid elevator of claim 18 wherein said first and said second pipes are in a side-by-side relationship and wherein said second pipe is secured to said first pipe.

20. A liquid elevator comprising:

an outer casing having a top defining a first hole in the center thereof and an open bottom;

a first pipe having one end sealed within said first hole and extending into said casing;

a second pipe extending out through said open bottom of said casing, said outer casing defining a second hole therein; and a coupling defining a passage therethrough, said passage having a funnel-shaped portion adjacent a cylindrically-shaped portion, said passage being radially aligned with the longitudinal axis of said coupling.

21. The liquid elevator of claim 20 wherein said first pipe is in sealed communication with said cylindrically-shaped portion of said coupling, and wherein said second pipe is in sealed communication with the funnel-shaped portion of a second, identical coupling.

22. A liquid elevator comprising:

an outer casing defining a reservoir therein and having a first and a second hole defined therein;

a first pipe extending through said first hole, said first pipe allowing communication between said reservoir and the outside of said outer casing; and a second pipe extending through said second hole, allowing communication between said reservoir and the outside of said outer casing;

said outer casing defining a third hole therein allowing communication between said reservoir and the outside of said outer casing.

23. The liquid elevator of claim 22 wherein said outer casing has a top and a bottom and wherein said reservoir has a top and a bottom and wherein first hole is disposed on the bottom of said outer casing and said second hole is disposed on the top of said outer casing, and further wherein liquid or gas entering said reservoir through said first pipe must fall from the top of said reservoir to the bottom of said reservoir before entering said second pipe.

24. The liquid elevator of claim 23 wherein said third hole is located near the top of said reservoir.

* * * * *